United States Patent [19]

Stone, Jr.

[11] 3,986,233

[45] Oct. 19, 1976

[54] TRANSVERSELY ADJUSTABLE BELT BUCKLE

[75] Inventor: Samuel M. Stone, Jr., Attleboro, Mass.

[73] Assignee: Swank, Inc., Attleboro, Mass.

[22] Filed: Sept. 24, 1975

[21] Appl. No.: 616,421

[52] U.S. Cl. ..... 24/77 R; 24/163 R; 24/182; 24/265 BC

[51] Int. Cl.[2] ..... A44B 11/22; A44B 11/25

[58] Field of Search ..... 24/163 R, 174, 164, 24/77, 265 BC, 265 R, 265 SA, 265 BA, 265 AL, 182, 173, 172, 165, 171, 201-202

[56] References Cited

UNITED STATES PATENTS

| | | | |
|---|---|---|---|
| 256,271 | 4/1882 | Bassett | 24/164 |
| 673,528 | 5/1901 | Wiseman | 24/164 |
| 1,005,890 | 10/1911 | Schultz | 24/164 |
| 1,826,174 | 10/1931 | Hodge | 24/163 R |
| 1,910,797 | 5/1933 | Joyce | 24/163 R |
| 2,156,647 | 5/1939 | Zeman | 24/186 |

*Primary Examiner*—Bernard A. Gelak
*Attorney, Agent, or Firm*—William R. Liberman

[57] ABSTRACT

A buckle adjustable for belts of different widths includes a flat rectangular housing open at its top and bottom and a pair of guide members including outer channel shaped tracks and vertical front plates extending through and slidably engaging the housing openings and retained in preselected positions by bowed leaf springs entrapped between the housing front wall and respective slide plates. Belt anchoring vertical tongues project inwardly from the outer trailing ends of the guide members and are rearwardly offset from the tracks and a curved belt eyelet engaging tongue is mounted on the housing rear wall.

9 Claims, 6 Drawing Figures

TRANSVERSELY ADJUSTABLE BELT BUCKLE

BACKGROUND OF THE INVENTION

The present invention relates generally to improvements in wearing apparel belts and it relates more particularly to an improved interchangeable apparel belt buckle.

The conventional apparel belt includes a belt, per se, and a belt buckle anchored to one end of the belt and releasably engaging in a fixed or adjustable manner the opposite end portion of the belt. However, belts come in various widths, colors and appearances, and belt buckles, likewise, come in different shapes, sizes and appearances. While the conventional belt buckle permits the adjustment of the girth of a belt in the wearer, it is applicable only to a belt of a predetermined width and possesses, as a consequence, other drawbacks and disadvantages. If a person desires a wide variety of belts of different widths and a wide assortment of buckles, the number of available belt and buckle combinations is greatly limited since each buckle can be applied or fitted to a belt matching the fixed width of the buckle. On the other hand, if the buckle were adjustable to fit belts of different widths, the number of available belt buckle combinations would be greatly increased or the number of belts and buckles required for a fixed number of belt buckle combinations would be greatly decreased.

SUMMARY OF THE INVENTION

It is a principal object of the present invention to provide an improved belt for apparel and other uses Another object of the present invention is to provide an improved interchangeable belt buckle.

Still another object of the present invention is to provide an improved interchangeable belt buckle which is adjustable for use with belts of different widths.

A further object of the present invention is to provide a belt buckle of the above nature characterized by its reliability, ruggedness, simplicity, ease of application, use and adjustment, attractive appearance and great versatility and adaptability.

The above and other objects of the present invention will become apparent from a reading of the following description taken in conjunction with the accompanying drawings which illustrate a preferred embodiment thereof.

In a sense the present invention contemplates the provision of an improved belt buckle adjustable to different widths of belt comprising a pair of transversely spaced guide members including transversely spaced longitudinally confronting parallel track sections, means for supporting the guide members for relative transverse adjustment, means for releasing maintaining the guide members in a preadjusted position, means for anchoring a first end portion of a belt to the buckle, and means for releasably locking a second portion of the belt remote from the first portion to the buckle.

In the preferred form of the improved belt buckle, each of the guide members included a vertical guide plate terminating at its top in a rearwardly projecting longitudinally extending track defining channel. A flat rectangular hollow sleeve or housing open at its top and bottom, vertically slidably receives the slide plates through the top and bottom openings, and a pair of bowed leaf springs, suitably positioned in the housing, is entrapped between the housing front wall and the slide plates to restrain the slipping of the guide members from their preadjusted positions. The belt trailing and loop is connected to the buckle by being engaged by vertical tongues projecting inwardly from the outer trailing corners of the guide members and rearwardly offset therefrom into the belt loop and the belt leading end portion is slidably engaged between the guide tracks and has spaced eyelets which are selectively engaged by a rearwardly curved tongue mounted on the housing rear wall.

The improved belt buckle is rapidly and easily adjusted and applied to belts of different widths and is simple, rugged, of attractive appearance, and of great versatility and adaptability.

DESCRIPTION OF THE PREFERRED EMBODIMENT

Figure 1:
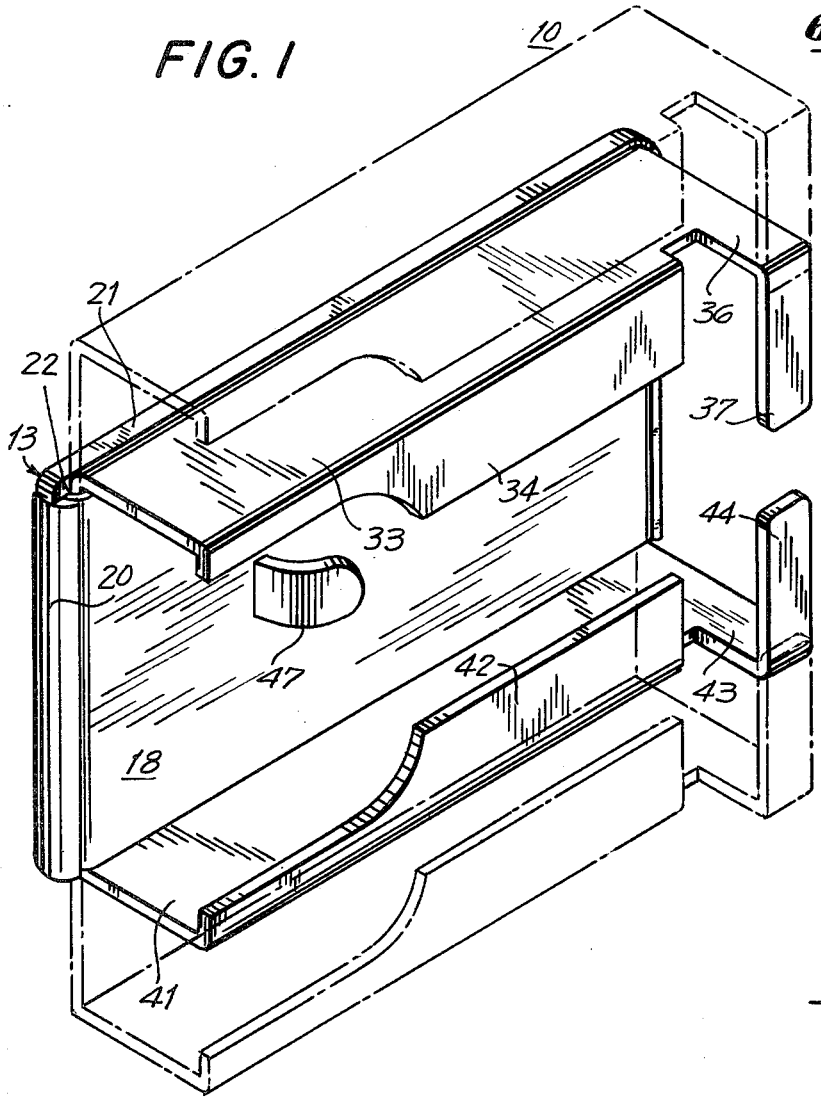
FIG. 1 is a rear perspective view of a belt buckle embodying the present invention, the belt guide members being shown by full line in contracted positions and by broken line in expanded positions.
Figure 4:
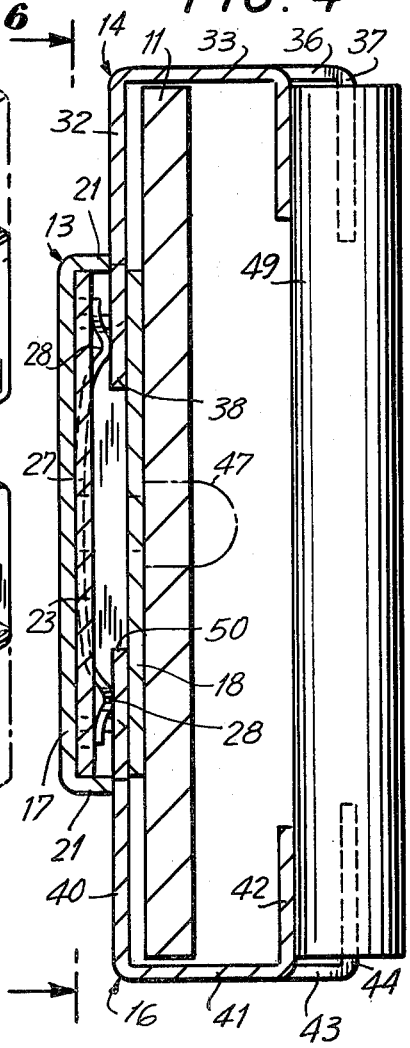
FIG. 4 is an enlarged sectional view taken along line 4—4 in FIG. 3.
Figure 2:
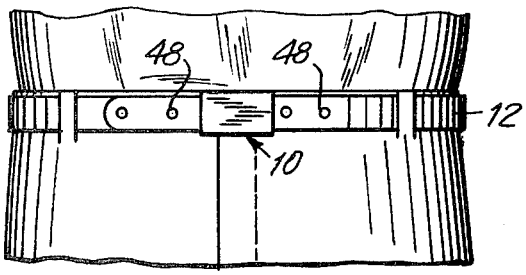
FIG. 2 is a front elevational view of the belt buckle shown applied to a narrow belt.
Figure 3:
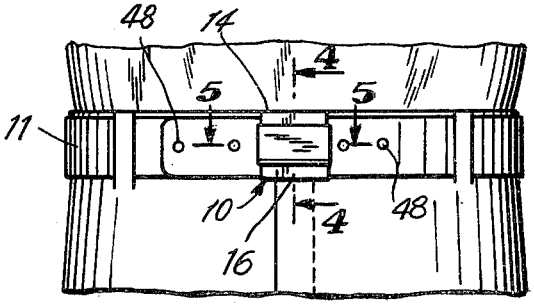
FIG. 3 is a front elevational view of the belt buckle shown applied to a wide belt.
Figure 5:
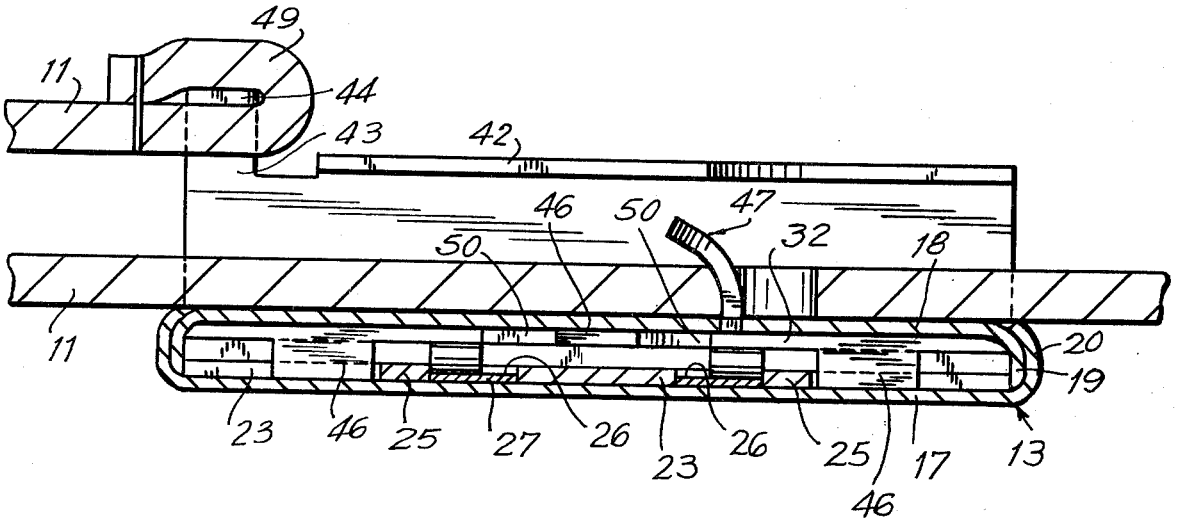
FIG. 5 is an enlarged sectional view taken along line 5—5 in FIG. 3.
Figure 6:
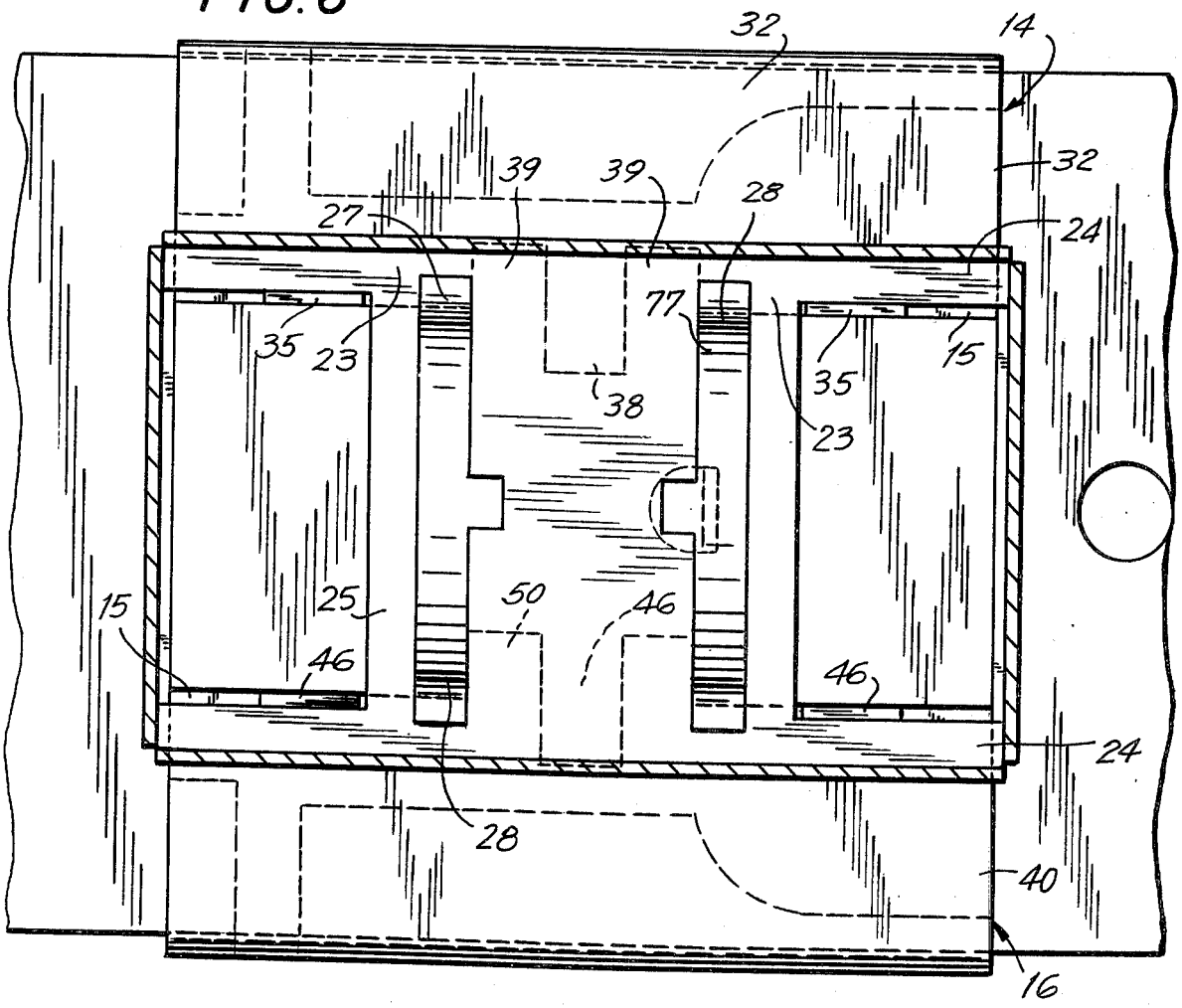
FIG. 6 is a sectional view taken along line 6—6 in FIG. 4.

Referring now to the drawings which illustrate a preferred embodiment of the present invention, the reference numeral 10 generally designates the improved belt buckle which is shown in FIGS. 1 and 3 to 6 as applied to a wide belt 11 and in FIG. 2 to a narrow belt 12. The buckle 10 comprises a generally flat rectangular housing 13 which vertically or transversely adjustably slidably supports a pair of upper and lower guide members 14 and 16 respectively projecting rearwardly of the housing 13.

The housing 13 includes similar rectangular front and rear walls 17 and 18 respectively, the rear wall 18 having forwardly directed vertical flanges 19 joined to the rear wall 18 by rounded corners and having front edges abutting the rear face of front wall 17. The front wall 17 has outwardly convex curved flanges 29 extending along the vertical side edges of front wall 17 and tightly embracing respective flanges 19 to firmly interlock the housing front and rear walls. Integrally formed along the top and bottom edges of front wall 17 are rearwardly directed horizontal flanges 21 which delineate with the top and bottom edges of rear wall 18 longitudinally extending openings or slots 22 providing access into the housing 13.

Superimposed on the rear face of front wall 17 and substantially coinciding therewith is a flat frame plate 23 having the side portions 15 thereof between its top and bottom binders cut away to provide top and bottom side legs 24 separated by the cut away portion. Also formed in the plate 23 symmetric to the medial vertical axis thereof are a pair of vertical narrow rectangular slots 26 which are separated from the cut out portions 15 by vertical legs 25 and extend for less than the full height of the plate 23 and include inwardly directed small rectangular openings intermediate the tops and bottoms thereof.

Partially nested in and conforming in outline with each of the slots 26 is a forwardly convex or medially bowed leaf spring 27, the front medial convex face of which extends along and bears on the rear face of front wall 17. The upper and lower free ends of the leaf springs 27 are substantially flat and bear on the rear face of plate 23 and the portions of the leaf springs 27 proximate their full ends are shaped or dimpled to form rearwardly projecting convex portions 28 which are rearwardly sprung rearwardly of plate 23.

The upper guide member 14 is an integrally formed unit and includes a vertical slide plate 32 vertically slidably engaging the housing top slot 22, a rearwardly directed horizontal web 33 extending along the full length of the top edge of slide plate 32 and terminating at its rear in a depending flange 34. The flange 34 is cut out at its leading lower portion and terminates at its trailing portion at a point short of the trailing end of web 33. Projecting horizontally rearwardly from the trailing corner of web 33 is a horizontal arm 36 which terminates in a depending vertical belt anchoring post or tongue 37 which is rearwardly offset from and projects below the flange 34.

The slide plate 32 is provided with a medial depending rectangular tongue 38 projecting below the lower edge of slide plate 32 and flanked by vertical rectangular recesses extending above the bottom edge of the slide plate. Projecting forwardly from opposite sides of the bottom edge of slide plate 32 through openings 15 proximate frame legs 25 into sliding engagement with rear face of housing front wall 17 are stop defining tabs 35.

The lower guide member 16 is likewise an integrally formed unit and includes a vertical slide plate 40 vertically slidably engaging the housing bottom longitudinal slot 22, a rearwardly directed horizontal web 41 extending along the full length of the bottom edge of slide plate 40 and terminating at its rear in an upwardly directed longitudinal flange 42. The flange 42 is cut out at its leading upper portion and terminates at its trailing portion at a point short of the trailing end of web 41. Projecting horizontally rearwardly from the trailing corner of web 41 is a horizontal arm 43 which terminates in an upwardly directed belt anchoring post or tongue 44 which is rearwardly offset from and projects above the flange 42 and is in vertical axial alignment with the upper anchor tongue 37.

The slide plate 40 is provided with a medial rectangular recess 46 for matingly slidingly receiving the upper slide plate tongue 38 and a pair of upwardly directed rectangular tongues 50 adapted to slidably engage upper recesses 39. Projecting forwardly from opposite sides of the top edge of slide plate 40 through openings 15 proximate frame legs 25 into sliding engagement with the rear face of housing front wall 17 are stop defining tabs 46.

Projecting rearwardly from the rear face of housing rear wall 18 and rigidly secured thereto is a belt eyelet engaging or belt locking tongue 47. The locking tongue is located along the rear wall medial longitudinal axis and is offset from the medial transverse axis in a leading direction. The tongue 47 is curved along the longitudinal axis and at least its outer portion is rearwardly inclined in a trailing direction to facilitate the releasable locking engagement with a selected eyelet in the associated belt 11 or 12.

In the application and operation of the improved belt buckle 10 described above, the conventially looped end 49 of the belt 11, independently of the width of the belt, is anchored to the buckle 10 by first spreading the guide members 14 and 16 to their fully expanded positions by pulling them apart against the frictional retention thereof effected by the leaf springs 27. The anchoring tongues 37 and 44 are then inserted into opposite ends of the belt loop 49 and the guide members 14 and 16 are then compressed and contracted until the outer edges of the belt loop 49 bear on arms 36 and 43 to limit the inward movement of the guide members 14 and 16 to proper positions accomodating the associated belt. The leaf springs 27 prevent the inadvertent outward expansion of the guide members. The belt and buckle are then employed in the conventional manner. To replace the belt 11 on the buckle 10, the guide members 14 and 16 are fully separated against the influence of leaf springs 27, the loop 49 separated from the anchoring tongues 37 and 47 and replaced by the loop of another belt for example of a narrower belt 12, and the guide members are again contracted.

While there has been described and illustrated a preferred embodiment of the present invention, it is apparent that numerous alterations, additions and omissions may be made without departing from the spirit thereof.

I claim:

1. In combination with a belt having a looped proximal end portion having transversely spaced opposite end openings, a belt buckle adjustable for different widths of belt comprising a pair of guide members including transversely spaced longitudinally guiding confronting parallel channel shaped track sections, means for supporting said guide members for relative transverse adjustment, means for anchoring said proximal end portion of said belt to said buckle including a pair of transversely aligned tongues projecting toward each other from proximate the trailing outer corners of said guide members through said opposite end openings into transverse sliding engagement with said looped end portion, and means for releasably locking a second end portion of said belt remote from said proximal portion to said buckle.

2. The belt buckle of claim 1 wherein said supporting means comprises a flat housing having a front wall and openings in the top and bottom thereof, and said guide members include slide sections projecting transversely from respective track sections into transversely sliding engagement with said housing through respective openings therein.

3. The belt buckle of claim 2 wherein said housing openings extend longitudinally for the lengths of said guide members and said slide sections comprise slide plates depending from respective track channels through said openings into sliding registry with said housing.

4. The belt buckle of claim 3 comprising means for releasably retaining said guide members in preadjusted positions including a spring entrapped between the confronting faces of the front wall of said housing and said slide plates.

5. The belt buckle of claim 1 wherein said anchoring tongues are rearwardly offset from said track sections.

6. The belt buckle of claim 1 wherein said housing includes a rear wall and said belt locking means comprises a locking tongue element mounted in and projecting rearwardly from said rear wall.

7. The belt buckle of claim 6 wherein said locking tongue is transversely medially located on said rear wall and curves toward the trailing end of said buckle.

8. A belt buckle adjustable for different widths of belt comprising a pair of guide members including transversely spaced longitudinally guiding confronting parallel track section defining channels, means for supporting said guide members for relative transverse adjustment and including a flat housing having a front wall and openings in the top and bottom thereof extending longitudinally for the lengths of said guide members, said guide members including slide sections defining slide plates projecting transversely from respective track sections into transversely sliding engagement with said housing through said respective openings therein, means for releasably retaining said guide members in preadjusted positions including a longitudinally spaced pair of bowed leaf springs entrapped between the confronting faces of the front wall of said housing and said slide plates, means for anchoring a first end portion of a belt to said buckle and means for releasably locking a second portion of said belt remote from said first portion to said buckle.

9. The belt buckle of claim 8 including a flat frame member disposed in said housing and overlying said housing front wall and having a pair of longitudinally spaced openings therein partially nesting said leaf springs.

* * * * *